United States Patent [19]

Silk et al.

[11] 4,269,695

[45] May 26, 1981

[54] RECLAIMING WAX CONTAMINATED LUBRICATING OILS

[75] Inventors: Murray R. Silk, Cherry Hill; Richard T. Cleveland, Turnersville, both of N.J.

[73] Assignee: Mobil Oil Corporation, New York, N.Y.

[21] Appl. No.: 63,025

[22] Filed: Aug. 1, 1979

[51] Int. Cl.[3] ..... C10G 45/00; C10G 45/62; C10G 45/64

[52] U.S. Cl. ..... 208/111; 208/46; 208/264; 585/737; 585/739

[58] Field of Search ..... 208/14, 18, 28, 33, 208/111, 264, 46, 85, 179; 585/737, 739

[56] References Cited

U.S. PATENT DOCUMENTS

| | | | |
|---|---|---|---|
| 3,755,138 | 8/1973 | Chen et al. | 208/33 |
| 3,926,777 | 12/1975 | Menzl | 208/14 |
| 3,960,705 | 6/1976 | Garwood et al. | 208/28 |

*Primary Examiner*—Delbert E. Gantz
*Assistant Examiner*—G. E. Schmitkons
*Attorney, Agent, or Firm*—C. A. Huggett; M. G. Gilman; V. J. Frilette

[57] ABSTRACT

Dewaxed lube base stock oil which forms a wax haze on storage at a temperature above its cloud point is treated by contacting the oil and hydrogen with a zeolite catalyst such as ZSM-5 to eliminate the wax-haze formation. The method may be used to reclaim wax-contaminated lube base stock oils and other wax-contaminated hydrocarbon oils.

16 Claims, 1 Drawing Figure

CATALYST AGING WHEN PROCESSING HEAVY NEUTRAL AND BRIGHT STOCK DEWAXED OILS
(A) HEAVY NEUTRAL
(B) BRIGHT STOCK
0.75°F/Day
0°F/Day
580
570
560
550
540
530
0
2
4
6
8
10
12
14
16
18
20
Days on Stream
Reactor Temperature, °F (Corrected to 20°F Pour Point)

RECLAIMING WAX CONTAMINATED LUBRICATING OILS

BACKGROUND OF THE INVENTION

1. Field of the Invention

This invention pertains to refining of lubricating oils. In particular, it pertains to reclaiming refined lubricant base stock oils which fail to meet specifications because of development of wax haze on storage.

2. Prior Art

High quality lube base stock oils are conventionally prepared by refining distillate fractions or the residuum prepared by vacuum distilling a suitable crude oil from which the lighter portion has been removed by distillation in an atmospheric tower. Thus, the charge to the vacuum tower is commonly referred to as a "long residuum", and the residuum from the vacuum tower is distinguished from the starting material by referring to it as the "short residuum".

The vacuum distillate fractions are upgraded by a sequence of unit operations, the first of which is solvent extraction with a solvent selective for aromatic hydrocarbons. This step serves to remove aromatic hydrocarbons of low viscosity index and provides a raffinate of improved viscosity index and quality. Various processes have been used in this extraction stage, and these employ solvents such as furfural, phenol, sulfur dioxide, and others. The short residuum, because it contains most of the asphaltenes of the crude oil, is conventionally treated to remove these asphalt-like constituents prior to solvent extraction to increase the viscosity index.

The raffinate from the solvent extraction step contains paraffins which adversely affect the pour point. Thus, the waxy raffinate, regardless of whether prepared from a distillate fraction or from the short residuum, must be dewaxed. Various dewaxing procedures have been used, and the art has gone in the direction of treatment with a solvent such as MEK/toluene mixtures to remove the wax and prepare a dewaxed raffinate. The dewaxed raffinate may then be finished by any of a number of sorption or catalytic processes to improve color and oxidation stability.

The quality of the lube base stock oil prepared by the sequence of operations outlined above depends on the particular crude chosen as well as the severity of treatment for each of the treatment steps. Additionally, the *yield* of high quality lube base stock oil also depends on these factors and, as a rule, the higher the quality sought, the less the yield because the refining steps are *subtractive* operations. Because of the yield penalties and the relatively high cost of the unit processes themselves, refined lube base stock oils are costly.

It sometimes happens in the course of routinely refining a lube oil that a product is made that is up to specifications except for some deficiency suggesting contamination by a small amount of high melting wax. For example, a refined oil may be prepared which is clear and bright and which has a satisfactory cloud point and pour point; however, on storage at a low temperature which is higher than the cloud point, a wax haze develops which makes the oil commercially unacceptable. In such a situation, it may be found, for example, that if the wax removed in the solvent-dewaxing operation is blended back with the oil and the dewaxing operation repeated, the product no longer develops wax-haze during storage.

The production of refined, dewaxed oils which do not meet specifications due to wax-contamination can occur is several ways. A small tear in the filter cloth on a drum filter, for example, may lead to a minor contamination by wax. Storage of the oil in vessels contaminated by wax is another possible source of the problem. One may speculate on other reasons for the occasional apparent wax-contamination in a process which normally produces acceptable lube oils, but such speculation is not particularly pertinent in the present context, which is concerned with reclaiming such wax-contaminated oils.

The refiner takes a severe economic penalty when a dewaxed oil is produced that fails some specification, such as a haze test, because the failure usually is discovered only after all the raw material and process costs have been expended to make the product. No way appears to be known that will effectively and economically remove the minute amount, usually less than about 2 wt.%, of wax contaminant. Contaminated oils that cannot in a practical way be mixed with acceptable oil to make an acceptable blend (i.e. "blended-off") may find no market or use other than to be fed to a catalytic cracking unit or burned as heavy fuel.

In recent years techniques have been proposed for catalytic dewaxing of petroleum stocks. A process of that nature developed by British Petroleum is described in The Oil and Gas Journal dated Jan. 6, 1975, at pages 69–73. See also U.S. Pat. No. 3,668,113.

In U.S. Pat. No. Re. 28,398 is described a process for catalytic dewaxing with a catalyst comprising zeolite ZSM-5. Such process combined with catalytic hydrofinishing is described in U.S. Pat. No. 3,894,938.

U.S. Pat. No. 3,755,138 discloses a two-step process for preparing low pour point lube oils, which process involves mild solvent dewaxing to an intermediate pour point followed by catalytic hydrodewaxing with a ZSM-5 type crystalline aluminosilicate zeolite.

The above-cited references all are concerned with removing substantial amounts of wax from waxy stocks with substantial reduction of the pour point of the oil.

It is an object of this invention to provide an inexpensive catalytic process for reclaiming refined lubricating oils contaminated by wax. It is a further object of this invention to provide a simple catalytic process for reclaiming, without substantial change of the pour point and other specifications of the oil, a dewaxed lube base stock oil having an excessive tendency to form particulate wax when stored. Other objects will be evident to those skilled in the art upon reading this entire specification including the claims thereof.

BRIEF SUMMARY OF INVENTION

Figure 1:
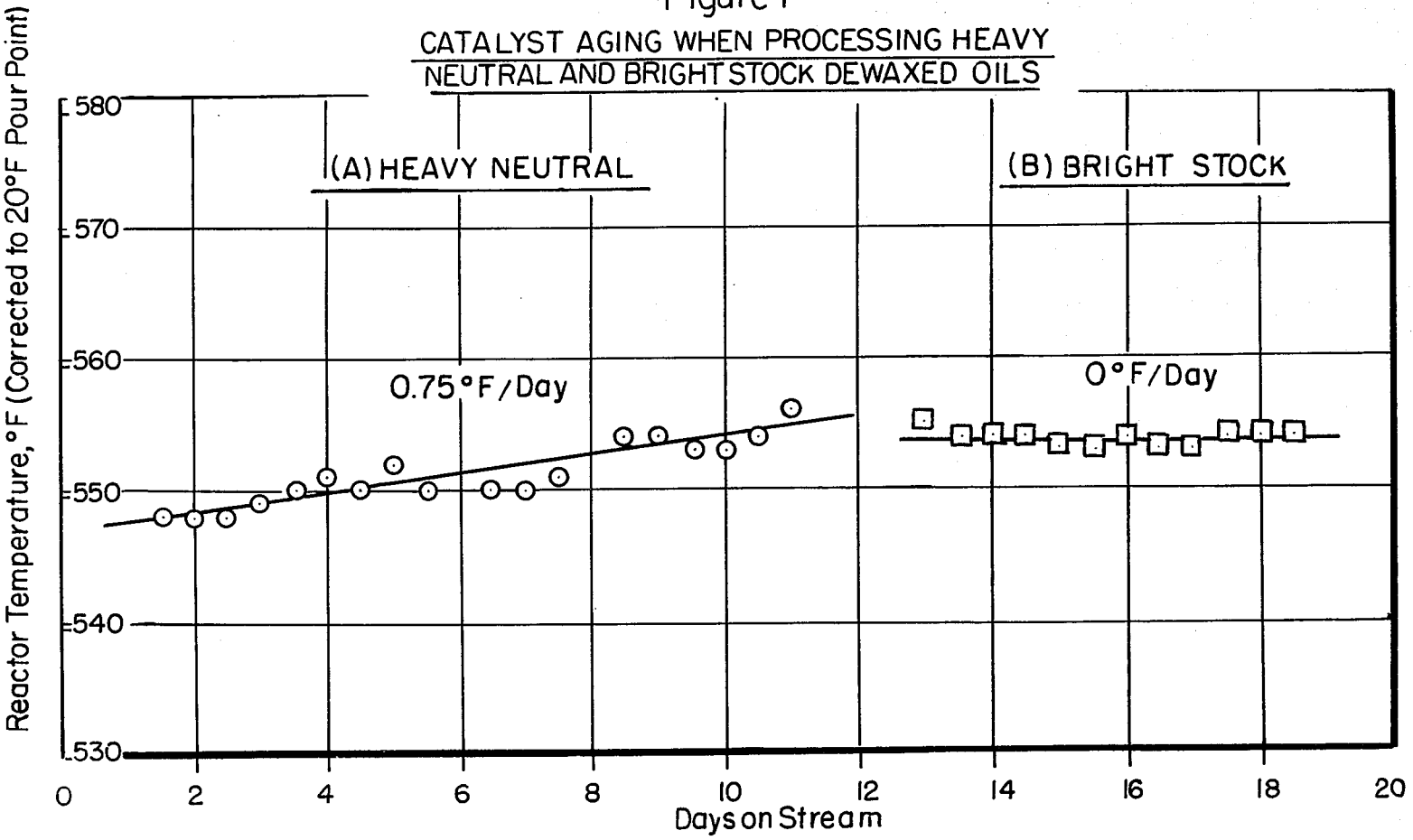
FIG. 1 (A)—Aging curve with Heavy Neutral Stock
FIG. 1 (B)—Aging curve with Bright Stock

It has now been found that a dewaxed, refined lube base stock oil with an excessive tendency to form particulate wax when stored at a predetermined temperature can be altered to decrease or eliminate that tendency without substantial change of its pour point. This improvement is effected according to this invention by catalytic contact with a crystalline aluminosilicate exemplified by ZSM-5, preferably associated with a hydrogenation metal. In its preferred form, more fully described hereinbelow, the process of this invention directly produces an upgraded base stock oil in very high yield, with essentially no loss in resistance to oxidation and no significant increase of bromine number. Thus, if the original base stock oil had satisfactory oxidation resistance, the product oil need not be hydrofinished. It is a further feature of this invention that, in general, the color of the lube base stock oil is improved by the process of this invention.

DETAILED DESCRIPTION OF INVENTION

The expression "the tendency of an oil to form particulate wax", as used herein, refers ultimately to the likelihood that a clear, bright oil, during storage under one or more sets of real conditions of time and temperatures, will form a suspension of waxy material likely to cause a filter or a fine nozzle to plug and thus impede the oil flow. The suspension of waxy material is particulate, and is referred to herein simply as particulate wax. The formation of such wax is usually observed as a haze, but any other form of separation or deposition is intended to be encompassed by the term "particulate wax". There are various tests used to measure this tendency. In general, these tests involve cooling the oil, storing the oil for a prescribed length of time, or both, at some predetermined temperature. Thus, two parameters are involved in assessing the tendency of an oil to form particulate wax. These are temperature and time. A refiner who wishes to assess this tendency by a specification test must *predetermine* the temperature of the test. If the test is to be conducted in a practical way, such as by observing the formation of wax haze in practical storage, the "predetermined temperature", as that term is used herein, is to be understood to include the ambient temperatures of the storage environment. Length of time of storage is somewhat arbitrary and dictated by judgment and experience in the design of the test. Some of the specification tests are visual and involve observing for the presence of haze, while others utilize an actual filtration. To illustrate a typical specification test, an overnight wax haze test suitable for refined oils with a pour point of about 20° F. is now described:

(a) Drying

Pour approximately 100 ml of the dewaxed oil through a 200 mesh gauze into one of the three necks of the 500 ml flask and then insert a thermometer with its bulb 5 mm from the bottom of the flask. In the second neck insert the blowing tube from the nitrogen regulators. Leave the third neck open as a vent to atmosphere. Slowly blow nitrogen through the oil, at a rate sufficient to create a froth on the surface, and heat the oil to 212° to 257° F. for a period of 30 minutes. After this period switch off the heat but continue to blow nitrogen through the oil until it has cooled to 104° F. or below.

(b) Refrigerating Dried Oil

Pour cooled dried oil into a bottle, tightly seal and store in refrigerator for 12–20 hours at 41° plus or minus 2° F. For Bright Stock or dark oils use a tall form 100 ml bottle and tightly seal with a well-fitting cork; for other oils use a standard 16 oz. screw-capped bottle.

(c) Interpretation and Reporting

Withdraw the sample from the refrigerator and place as quickly as possible against a white light background, observe if a wax haze is present, and report Pass or Fail.

If a haze is present: insert a thermometer and, while allowing the sample to warm at room temperature, slowly move the bulb of the thermometer back and forth across the bottle; record the temperature when the sample becomes haze free.

In the foregoing test, the predetermined temperature is, of course, 41° F. An oil which does not pass the foregoing test is to be understood to have an "excessive" tendency to form particulate wax at that predetermined storage temperature.

Lube base stock oils with a pour point of about 20° F. and a cloud point of about 32° F. which fail the foregoing storage test are illustrative of oils with an excessive tendency to form particulate wax on storage. The foregoing test of course may be made more or less severe by altering the storage temperature, as dictated by the end-use environment and the experience of the refiner. An acceptable tendency to form particulate wax on storage is evidenced in an oil treated by the process of this invention by the substantial absence of haze, or a substantial diminution of the degree of haziness, or a reduction in the temperature at which the hazy stored sample becomes haze-free on warming, when the treated oil is examined at the predetermined temperature. The foregoing test is exemplary and is believed to be diagnostic for the presence of high melting wax, probably introduced by contamination, in a dewaxed oil. It is to be understood, of course, that other tests may be used for purposes of this invention to determine whether or not a dewaxed oil has an excessive tendency to form particulate wax.

In the process of the present invention, a dewaxed lube base stock oil with an excessive tendency to form particulate wax when stored at a storage temperature above its cloud point is contacted in the presence of hydrogen at a temperature of 500° to 675° F. and at a space velocity higher than 2 up to about 10 LHSV (Liquid Hourly Space Velocity, i.e. volumes of oil per volume of catalyst per hour) with a catalyst comprising a hydrogenation component and an aluminosilicate zeolite having a silica/alumina ratio of at least about 12 and a Constraint Index of about 1 to about 12. The oil, after said contacting, is flashed to remove whatever volatile products may be formed during treatment. The reaction conditions are chosen so that at least 95 wt.%, and preferably at least 97 wt.% yield of treated oil is obtained after removal of volatiles. In its particularly preferred form, the process conditions are so chosen to produce a recovered oil free of volatiles which has a bromine number not significantly higher than the feed. Contacting is conducted with a hydrogen partial pressure of about 100 to 1500 psia, and with a hydrogen recirculation of about 50 to 3000 standard cubic feet of hydrogen per barrel of feed (SCF/B).

The dewaxed lube base stock oil used in the process of this invention may be one prepared from a distillate fraction boiling in the range from about 450°, and preferably at least 600° F., up to 1100° F., or it may be a bright stock prepared from a residual fraction. In addition to dewaxing, either by a catalytic method or by solvent dewaxing, to produce a base stock having a satisfactory pour point, the oil may be solvent extracted to increase its viscosity index, or, in the case of a residual fraction, even deasphalted. Other processes such as clay percolation or hydrofinishing may have been employed. In any case, it is preferred that the lube base stock oil be treated by the method of this invention prior to being modified by additives such as antioxidants, for example.

The extent of contamination of the base stock oil with high melting waxes may vary from so little as to have no effect on the pour point to enough to cause a small but detectable increase thereof. The process of the present invention is useful to correct an excessive tendency to form particulate wax in both instances, and to simultaneously reduce the pour point by not more than 20° F. when this has been raised by the contaminant.

The catalyst used in the process of this invention comprises a hydrogenation component associated with a particular crystalline aluminosilicate zeolite of the type now to be described.

CRYSTALLINE ALUMINOSILICATE ZEOLITES

The crystalline aluminosilicates utilized herein are members of a novel class of zeolites that exhibit unusual properties. Although these zeolites have unusually low alumina contents, i.e. high silica to alumina ratios, they are very active even when the silica to alumina ratio exceeds 30. The activity is surprising since catalytic activity is generally attributed to framework aluminum atoms and/or cations associated with these aluminum atoms. These zeolites retain their crystallinity for long periods in spite of the presence of steam at high temperature which induces irreversible collapse of the framework of other zeolites, e.g. of the X and A type. Furthermore, carbonaceous deposits, when formed, may be removed by burning at higher than usual temperatures to restore activity. These zeolites, used as catalysts, generally have low coke-forming activity and therefore are conducive to long times on stream between regenerations by burning with oxygen-containing gas such as air.

An important characteristic of the crystal structure of this class of zeolites is that it provides constrained access to and egress from the intracrystalline free space by virtue of having an effective pore size intermediate between the small pore Linde A and the large pore Linde X, i.e. the pore windows of the structure have about a size such as would be provided by 10-membered rings of oxygen atoms. It is to be understood, of course, that these rings are those formed by the regular disposition of the tetrahedra making up the anionic framework of the crystalline aluminosilicate, the oxygen atoms themselves being bonded to the silicon or aluminum atoms at the centers of the tetrahedra. Briefly, the preferred type zeolites useful in this invention possess, in combination: a silica to alumina mole ratio of at least about 12; and a structure providing constrained access to the crystalline free space.

The silica to alumina ratio referred to may be determined by conventional analysis. This ratio is meant to represent, as closely as possible, the ratio in the rigid anionic framework of the zeolite crystal and to exclude aluminum in the binder or in cationic or other form within the channels. Although zeolites with a silica to alumina ratio of at least 12 are useful, it is preferred to use zeolites having higher ratios of at least about 30. Such zeolites, after activation, acquire an intracrystalline sorption capacity for normal hexane which is greater than that for water, i.e. they exhibit "hydrophobic" properties. It is believed that this hydrophobic character is advantageous in the present invention.

The zeolites useful in this invention have an effective pore size such as to freely sorb normal hexane. In addition, the structure must provide constrained access to larger molecules. It is sometimes possible to judge from a known crystal structure whether such constrained access exists. For example, if the only pore windows in a crystal are formed by 8-membered rings of oxygen atoms, then access by molecules of larger cross-section than normal hexane is excluded and the zeolite is not of the desired type. Windows of 10-membered rings are preferred, although in some instances excessive puckering of the rings or pore blockage may render these zeolites ineffective. 12-membered rings usually do not offer sufficient constraint to produce the advantageous conversions, although the puckered 12-ring structure of TMA offretite shows constrained access. Other 12-ring structures may exist which, due to pore blockage or to other cause, may be operative.

Rather than attempt to judge from crystal structure whether or not a zeolite possesses the necessary constrained access to molecules larger than normal paraffins, a simple determination of the "Constraint Index" as herein defined may be made by passing continuously a mixture of an equal weight of normal hexane and 3-methylpentane over a small sample, approximately one gram or less, of zeolite at atmospheric pressure according to the following procedure. A sample of the zeolite, in the form of pellets or extrudate, is crushed to a particle size about that of coarse sand and mounted in a glass tube. Prior to testing, the zeolite is treated with a stream of air at 1000° F. for at least 15 minutes. The zeolite is then flushed with helium and the temperature is adjusted between 550° F. and 950° F. to give an overall conversion between 10% and 60%. The mixture of hydrocarbons is passed at 1 liquid hourly space velocity (i.e., 1 volume of liquid hydrocarbon per volume of zeolite per hour) over the zeolite with a helium dilution to give a helium to total hydrocarbon mole ratio of 4:1. After 20 minutes on stream, a sample of the effluent is taken and analyzed, most conveniently by gas chromatography, to determine the fraction remaining unchanged for each of the two hydrocarbons.

The "Constraint Index" is calculated as follows:

$$\text{Constraint Index} = \frac{\log_{10}(\text{fraction of n-hexane remaining})}{\log_{10}(\text{fraction of 3-methylpentane remaining})}$$

The Constraint Index approximates the ratio of the cracking rate constants for the two hydrocarbons. Zeolites suitable for the present invention are those having a Constraint Index of 1 to 12. Constraint Index (CI) values for some typical zeolites are:

| CAS | C.I. |
|---|---|
| ZSM-4 | 0.5 |
| ZSM-5 | 8.3 |
| ZSM-11 | 8.7 |
| ZSM-12 | 2 |
| ZSM-23 | 9.1 |
| ZSM-35 | 4.5 |
| ZSM-38 | 2 |
| TMA Offretite | 3.7 |
| Beta | 0.6 |
| H-Zeolon (mordenite) | 0.4 |
| REY | 0.4 |
| Amorphous Silica-Alumina | 0.6 |
| Erionite | 38 |

The above-described Constraint Index is an important and even critical definition of those zeolites which are useful in the instant invention. The very nature of this parameter and the recited technique by which it is determined, however, admit of the possibility that a given zeolite can be tested under somewhat different conditions and thereby have different Constraint Indexes. Constraint Index seems to vary somewhat with severity of operation (conversion) and the presence or absence of binders. Therefore, it will be appreciated that it may be possible to so select test conditions to establish more than one value in the range of 1 to 12 for the Constraint Index of a particular zeolite. Such a zeolite exhibits the constrained access as herein defined and is to be regarded as having a Constraint Index of 1 to 12. Also contemplated herein as having a Constraint Index of 1 to 12 and therefore within the scope of the novel class of highly siliceous zeolites are those zeolites which, when tested under two or more sets of conditions within the above-specified ranges of temperature and conversion, produce a value of the Constraint Index slightly less than 1, e.g. 0.9, or somewhat greater than 12, e.g. 14 or 15, with at least one other value of 1 to 12. Thus, it should be understood that the Constraint Index value as used herein is an inclusive rathter than an exclusive value. That is, a zeolite when tested by any combination of conditions within the testing definition set forth hereinabove and found to have a Constraint Index of 1 to 12 is intended to be included in the instant catalyst definition regardless that the same identical zeolite tested under other defined conditions may give a Constraint Index value outside of 1 to 12.

The class of zeolites defined herein is exemplified by ZSM-5, ZSM-11, ZSM-12, ZSM-23, ZSM-35, ZSM-38, and other similar materials. U.S. Pat. No. 3,702,886 describing and claiming ZSM-5 is incorporated herein by reference.

ZSM-11 is more particularly described in U.S. Pat. No. 3,709,979, the entire content of which is incorporated herein by reference.

ZSM-12 is more particularly described in U.S. Pat. No. 3,832,449, the entire content of which is incorporated herein by reference.

ZSM-23 is more particularly described in U.S. Pat. No. 4,076,842, the entire content of which is incorporated herein by reference.

ZSM-35 is more particularly described in U.S. Pat. No. 4,016,245, the entire content of which is incorporated herein by reference.

ZSM-38 is more particulary described in U.S. Pat. No. 4,046,859, the entire content of which is incorporated herein by reference.

The specific zeolites described, when prepared in the presence of organic cations, are substantially catalystically inactive, possibly because the intracrystalline free space is occupied by organic cations from the forming solution. They may be activated by heating in an inert atmosphere at 1000° F. for one hour, for example, followed by base exchange with ammonium salts followed by calcination at 1000° F. in air. The presence of organic cations in the forming solution may not be absolutely essential to the formation of this type zeolite; however, the presence of these cations does appear to favor the formation of this special class of zeolite. More generally, it is desirable to activate this type catalyst by base exchange with ammonium salts followed by calcination in air at about 1000° F. for from about 15 minutes to about 24 hours.

Natural zeolites may sometimes be converted to this type zeolite catalyst by various activation procedures and other treatments such as base exchange, steaming, alumina extraction and calcination, in combinations. Natural minerals which may be so treated include ferrierite, brewsterite, stilbite, dachiardite, epistilbite, heulandite, and clinoptilolite. The preferred crystalline aluminsolicates are ZSM-5, ZSM-11, ZSM-12, ZSM-23, ZSM-35, and ZSM-38, with ZSM-5 being particularly preferred.

In a preferred aspect of this invention, the zeolites hereof are selected as those having a crystal framework density, in the dry hydrogen form, of not less than about 1.6 grams per cubic centimeter. It has been found that zeolites which satisfy all three of these criteria are most desired for several reasons. When hydrocarbon by-products are catalytically formed, for example, such zeolites tend to maximize the production of gasoline boiling range hydrocarbons. Therefore, the preferred zeolites of this invention are those having a Constraint Index as defined above of about 1 to about 12, a silica to alumina ratio of at least about 12 and a dried crystal density of not less than about 1.6 grams per cubic centimeter. The dry density for known structures may be calculated from the number of silicon plus aluminum atoms per 1000 cubic Angstroms, as given, e.g., on Page 19 of the article on Zeolite Structure by W. M. Meier. This paper, the entire contents of which are incorporated herein by reference, is included in "Proceedings of the Conference on Molecular Sieves, London, April 1967," published by the Society of Chemical Industry, London, 1968. When the crystal structure is unknown, the crystal framework density may be determined by classical pyknometer techniques. For example, it may be determined by immersing the dry hydrogen form of the zeolite in an organic solvent which is not sorbed by the crystal. Or, the crystal density may be determined by mercury porosimetry, since mercury will fill the interstices between crystals but will not penetrate the intracrystalline free space. It is possible that the unusual sustained activity and stability of this class of zeolites is associated with its high crystal anionic framework density of not less than about 1.6 grams per cubic centimeter. This high density must necessarily be associated with a relatively small amount of free space within the crystal, which might be expected to result in more stable structures. This free space, however, is important as the locus of catalytic activity.

Crystal framework densities of some typical zeolites including some which are not within the purview of this invention are:

| Zeolite | Void Volume | Framework Density |
|---|---|---|
| Ferrierite | 0.28 cc/cc | 1.76 g/cc |
| Mordenite | .28 | 1.7 |
| ZSM-5, -11 | .29 | 1.79 |
| ZSM-12 | — | 1.8 |
| ZSM-23 | — | 2.0 |
| Dachiardite | .32 | 1.72 |
| L | .32 | 1.61 |
| Clinoptilolite | .34 | 1.71 |
| Laumontite | .34 | 1.77 |
| ZSM-4 (Omega) | .38 | 1.65 |
| Heulandite | .39 | 1.69 |
| P | .41 | 1.57 |
| Offretite | .40 | 1.55 |
| Levynite | .40 | 1.54 |
| Erionite | .35 | 1.51 |
| Gmelinite | .44 | 1.46 |
| Chabazite | .47 | 1.45 |
| A | .5 | 1.3 |

-continued

| Zeolite | Void Volume | Framework Density |
|---|---|---|
| Y | .48 | 1.27 |

When synthesized in the alkali metal form, the zeolite is conveniently converted to the hydrogen form, generally by intermediate formation of the ammonium form as a result of ammonium ion exchange and calcination of the ammonium form to yield the hydrogen form. In addition to the hydrogen form, other forms of the zeolite wherein the original alkali metal has been reduced to less than about 1.5 percent by weight may be used. Thus, the original alkali metal of the zeolite may be replaced by ion exchange with other suitable metal cations of Groups I through VIII of the Periodic Table, including, by way of example, nickel, copper, zinc, palladium, calcium or rare earth metals.

In practicing the desired conversion process, it may be desirable to incorporate the above-described crystalline aluminosilicate zeolite in another material resistant to the temperature and other conditions employed in the process. Such matrix materials include synthetic or naturally occurring substances as well as inorganic materials such as clay, silica and/or metal oxides. The latter may be either naturally occurring or in the form of gelatinous precipitates or gels including mixtures of silica and metal oxides. Naturally occurring clays which can be composited with the zeolite include those of the montmorillonite and kaolin families, which families include the sub-bentonites and the kaolins commonly known as Dixie, McNamee-Georgia and Florida clays or others in which the main mineral constituent is halloysite, kaolinite, dickite, nacrite or anauxite. Such clays can be used in the raw state as originally mined or initially subjected to calcination, acid treatment or chemical modification.

In addition to the foregoing materials, the zeolites employed herein may be composited with a porous matrix material, such as alumina, silica-alumina, silica-magnesia, silica-zirconia, silica-thoria, silica-berylia, slica-titania as well as ternary compositions, such as silica-alumina-thoria, silica-alumina-zirconia, silica-alumina-magnesia and silica-magnesia-zirconia. The matrix may be in the form of a cogel. The relative proportions of zeolite component and inorganic oxide gel matrix on an anhydrous basis may vary widely with the zeolite content ranging from between about 1 to about 99 percent by weight and more usually in the range of about 5 to about 80 percent by weight of the dry composite.

ZSM-5, as noted above, is the particularly preferred zeolite for the purpose of this invention. The preferred *catalyst* is ZSM-5 in a matrix, with the zeolite constituting about 40 to 80 wt.% of the dry catalyst. The preferred catalyst further has an alpha value within the range of 25 to 150. This alpha value is preferably achieved by steaming, prior to use, a catalyst with an alpha value in excess of 150, as more fully described in copending U.S. patent application Ser. No. 052,718 filed June 27, 1979, the entire content of which is incorporated herein by reference.

An "alpha value" or "alpha activity" is a measure of normal hexane cracking conversion relative to a silica-alumina cracking catalyst and the alpha test is described in a Letter to the Editor entitled "Superactive Crystalline Aluminosilicate Hydrocarbon Cracking Catalyst" by P. B. Weisz and J. N. Miale, Journal of Catalysis, Vol. 4, No. 4, August 1965, pages 527–529, said article being herein incorporated by reference.

For purposes of this invention, the preferred catalyst contains a hydrogenation component exemplified by nickel. This may be introduced by base exchange, as more fully described in the foregoing copending U.S. patent application Ser. No. 052,718.

In the process of this invention, the contaminated oil and hydrogen may be contacted with the catalyst in any conventional manner, preferably employing a fixed bed catalyst. After deactivation by protracted use, the catalyst may be regenerated by treatment with hydrogen at elevated temperature.

The following examples will serve to illustrate the invention hereinabove described. It is to be understood that this invention is not to be construed as limited by the examples, which are merely illustrative. All parts and proportions are by weight unless explicitly stated to be otherwise.

EXAMPLE 1

A catalyst in the form of 1/16 inch extrudate, composed of about 65% ZSM-5, about 35% alumina, and which had been base exchanged with nickel nitrate to incorporate a small amount of nickel in the composition, was charged to a pilot plant reactor. The catalyst had been previously steamed to an alpha value of about 70. The catalyst was sulfided in the reactor with a synthetic mixture containing 2%, $H_2S$, 20% hydrocarbon and other gases added to simulate the off-gas from a catalytic hydrodesulfurization unit.

EXAMPLE 2

A commercial high V.I. (Viscosity Index) heavy neutral base stock oil having a cloud point of 42° F. and which formed a wax haze within a week when stored at ambient temperatures of about 40°–70° F., together with hydrogen gas of 80% purity, was passed over the sulfided catalyst of Example 1 at 2.9 LHSV with a hydrogen partial pressure of 275 psia and a hydrogen circulation rate of 600 SCF/B. After six days on stream pure hydrogen was substittued for the hydrogen mixture and the run continued for an additional five days, with no apparent effect on the aging rate of the catalyst, which is shown in FIG. 1. Run conditions were chosen to give a slight pour point reduction (15° F.) which was required to meet the 20° F. pour point specification. Dehazed oil yield was 98.7% volume with all of the lighter products in the $C_3$ to naphtha boiling range. The dehazed oil viscosity index was 98 at 20° F. pour point and ASTM color was improved 1 number over the charge stock. All pilot unit samples passed the 41° F. wax haze test described above. Physical properties and yield breakdowns for the heavy neutral are included in Tables I and II. The reclaimed lube product showed no significant increase of bromine number and no increased susceptibility to oxidation as measured in a rotating oxygen bomb test, as compared with the contaminated feed.

EXAMPLE 3

On completion of the test described in Example 2, a second test was made with a contaminated bright stock which failed in the above described 41° F. wax haze test. The catalyst used in Example 2 was used for this test without regeneration. The reaction conditions and product yield are shown in Table III. Properties of the feed and reclaimed product are shown in Table IV. The reclaimed oil passed the 41° F. wax haze test and showed no evidence of reduced stability compared with the feed. There was no reduction in pour point of the reclaimed oil.

TABLE I

Reaction Conditions and Product Yield, Heavy Neutral Feed

| Reaction Conditions | | |
|---|---|---|
| Reactor Pressure, psig $H_2$ | | 275 |
| Reactor Temperature, °F. | | 550 |
| LHSV, VFF/Hr/VCAT | | 3.0 |
| Desulfurization, % wt | | 0 |
| $H_2$ Circulation, SCF/B | | 440 |
| $H_2$ Consumed, SCF/B | | −30 |
| Catalyst Aging, °F./Day | | 0.75 |
| Cycle Age, Days | | 10.5 |
| Material Balance, % wt | | 98.8 |
| Lube Product (650°F.+) Pour Point, °F. | | 20 |
| Product Yields | % vol | % wt |
| Hydrogen Sulfide | — | 0.0 |
| Methane | — | 0.0 |
| Ethene | — | 0.0 |
| Ethane | — | 0.0 |
| Total Dry Gas | — | 0.0 |
| Propene | — | 0.0 |
| Propane | — | 0.2 |
| Total $C_3$'s | — | 0.2 |
| Isobutane | 0.3 | 0.2 |
| Butenes | 0.1 | 0.1 |
| N-Butane | 0.2 | 0.1 |
| Total $C_4$'s | 0.6 | 0.4 |
| Isopentane | 0.1 | 0.1 |
| Pentenes | 0.2 | 0.1 |
| N-Pentane | 0.2 | 0.1 |
| Total $C_5$'s | 0.5 | 0.3 |
| 125–330° F. Naphtha | 0.9 | 0.7 |
| 330–650° F. Kerosine | 0.0 | 0.0 |
| Lube Stock (650° F. +) | 98.6 | 98.4 |
| Total Product | 100.6 | 100.0 |

TABLE II

Properties of Heavy Neutral Feed and Reclaimed Oil

| | Hazy Oil Feed | Reclaimed Oil |
|---|---|---|
| Yield, % volume on Process | — | 98.7 |
| Gravity, API | 27.6 | 28.1 |
| Gravity, Specific @60° C. | 0.8894 | 0.8866 |
| Pour Point, °F. | 35 | 20 |
| Cloud Point, °F. O | 42 | 30 |
| Flash Point, °F. (C.O.C.) | 510 | 500 |
| SUS @ 100° F. Seconds | 460 | 480 |
| SUS @ 210° F. Seconds | 61.5 | 62.2 |
| Viscosity Index | 99.6 | 97.8 |
| Color, ASTM | 3 | 2 |
| Neutralization No., Mg KOH/gm | <0.05 | 0.05 |
| Carbon Residue, % wt (RCR) | 0.12 | 0.15 |
| Sulfur, % wt | 0.90 | 1.05 |
| Nitrogen, ppm | 53 | 65 |
| Refractive Index @ 20° C. | 1.48747 | 1.48832 |
| Refractive Index @ 70° C. | 1.47015 | 1.47004 |
| Aniline Point, °F. | 226.5 | 227.9 |
| Furfural, ppm | 1 | <1 |

TABLE III

Reaction Conditions and Product Yield Bright Stock Feed

| | | |
|---|---|---|
| Reactor Pressure, psig $H_2$ | | 275 |
| Reactor Temperature, °F. | | 553 |
| LHSV, VFF/Hr/VCAT | | 3.0 |
| Desulfurization, % wt | | 0 |
| $H_2$ Circulation, SCF/B | | 590 |
| $H_2$ Consumed, SCF/B | | 75 |
| Catalyst Aging, °F./Day | | 0 |
| Cycle Age, Days | | 17 |

TABLE III-continued

Reaction Conditions and Product Yield Bright Stock Feed

| | | |
|---|---|---|
| Material Balance, % wt | | 100.7 |
| Lube Product (800° F.+) Pour Point, °F. | | 20 |
| Product Yields | % vol | % wt |
| Hydrogen Sulfide | — | 0.0 |
| Methane | — | 0.0 |
| Ethene | — | 0.0 |
| Ethane | — | 0.0 |
| Total Dry Gas | — | 0.0 |
| Propene | — | 0.0 |
| Propane | — | 0.1 |
| Total $C_3$'s | | |
| Isobutane | 0.3 | 0.2 |
| Butenes | 0.0 | 0.0 |
| N-Butane | 0.1 | 0.1 |
| Total $C_4$'s | 0.4 | 0.3 |
| Isopentane | 0.1 | 0.1 |
| Pentenes | 0.1 | 0.0 |
| N-Pentane | 0.1 | 0.1 |
| Total $C_5$'s | 0.3 | 0.2 |
| 125–330° F. Naphtha | 0.5 | 0.4 |
| 330–800° F. Kerosine | 0.0 | 0.0 |
| Lube Stock (800° F.+) | 99.5 | 99.2 |
| Total Product | 100.7 | 100.2 |

TABLE IV

Properties of Bright Stock Feed and Reclaimed Oil

| | Hazy Oil Feed | Reclaimed Oil |
|---|---|---|
| Yield, % volume on Process | — | 99.1 |
| Gravity, °API | 23.9 | 24.4 |
| Gravity, Specific @ 60° F. | 0.9106 | 0.9075 |
| Pour Point, °F. | 20 | 20 |
| Cloud Point, °F. | — | 22 |
| Flash Point, °F. (C.O.C.) | 575 | 595 |
| SUS @ 100° F. Seconds | 2560 | 2595 |
| SUS @ 210° F. Seconds | 149.8 | 151.5 |
| Viscosity Index | 93.7 | 94.0 |
| Color, ASTM | 7 | 5½ |
| Neutralization No. Mg KOH/gm | <0.05 | 0.12 |
| Carbon Residue, % wt (RCR) | 0.69 | 0.70 |
| Sulfur, % wt | 1.37 | 1.57 |
| Nitrogen, ppm | 150 | 180 |
| Refractive Index @ 20° C. | — | 1.50052 |
| Refractive Index @ 70° C. | — | 1.48258 |
| Aniline Point, °F. | 240.0 | 243.3 |
| Furfural, ppm | 1 | <1 |

OTHER EMBODIMENTS

The process of this invention has been described in detail for reclaiming contaminated dewaxed lube oil stocks since this embodiment is of particular value. Those skilled in the art will recognize that the hereindescribed process may be adapted to treat other wax-contaminated hydrocarbon oils such as jet fuel, diesel fuel, and other fuels and lubricants. Contemplated as within the scope of this invention, therefore, is a process for upgrading or reclaiming any hydrocarbon oil boiling above about 400° F. and which forms undesirable particulate wax on storage at a predetermined temperature, which process utilizes the catalyst and process conditions hereinabove set forth. Thus, dehazing of hazy naphthenic oils is contemplated, regardless whether the wax haze is due to contamination or to the natural composition of said oil or fraction thereof.

In describing this invention, reference has been made in the text and tables to various specifications such as color, pour point, etc. These specifications refer to published standard test methods of the American Society for Testing Materials of Philadelphia, Pa., or the equivalent thereof, as follows:

| Test | Method |
|---|---|
| Pour Point | ASTM-D-97 |
| Cloud Point | ASTM-D-2500 |
| V.I. | ASTM-D-2270 |
| Color | ASTM-D-1500 |

What is claimed is:

1. A method for reclaiming a contaminated dewaxed lube base stock oil with an excessive tendency to form particulate wax when kept at a predetermined storage temperature, which method consists of: contacting said dewaxed oil and hydrogen in a single reaction zone at a temperature of 500° to 675° F., a hydrogen partial pressure of about 100 to 1500 psia, and at a space velocity higher than 2 up to about 10 LHSV with a catalyst comprising a crystalline aluminosilicate zeolite having a silica/alumina ratio of at least 12 and a Constraint Index of about 1 to about 12; and recovering at least 95 wt.% of a reclaimed lube base stock oil having a pour point not more than 20° F. lower than said contaminated oil, and which forms substantially no particulate wax at said storage temperature.

2. The method described in claim 1 wherein said reclaimed lube oil is recovered in at least 97 wt.% yield.

3. The method described in claim 1 wherein said predetermined storage temperature is at least about 10° F. higher than the cloud point of said contaminated oil.

4. The method described in claim 2 wherein the pour point of said reclaimed lube base stock oil is about the same as the pour point of said contaminated oil.

5. The method described in claim 2 wherein said predetermined storage temperature is at least about 10° F. higher than the cloud point of said contaminated oil.

6. The method described in claim 5 wherein the pour point of said reclaimed lube oil is substantially the same as the pour point of said contaminated oil.

7. The method described in claim 1 wherein said catalyst comprises ZSM-5 and a hydrogenation component.

8. The method described in claim 2 wherein said catalyst comprises ZSM-5 and a hydrogenation component.

9. The method described in claim 3 wherein said catalyst comprises ZSM-5 and a hydrogenation component.

10. The method described in claim 4 wherein said catalyst comprises ZSM-5 and a hydrogenation component.

11. The method described in claim 5 wherein said catalyst comprises ZSM-5 and a hydrogenation component.

12. The method described in claim 6 wherein said catalyst comprises ZSM-5 and a hydrogenation component.

13. The method described in claim 7 or claim 8 or claim 9 or claim 10 or claim 11 or claim 12 wherein said catalyst has an alpha value in the range of about 25 to 150.

14. The method described in claim 7 or claim 8 or claim 9 or claim 10 or claim 11 or claim 12 wherein said catalyst has an alpha value in the range of about 25 to 150 and consists of ZSM-5 in a matrix and said hydrogenation component is nickel.

15. A method for upgrading a hydrocarbon oil which forms undesirable particulate wax when kept at a predetermined storage temperature, which method comprises: contacting said oil and hydrogen at from 500° to 675° F. and at a space velocity higher than 2 up to about 10 LHSV with a catalyst comprising a hydrogenation component and a crystalline aluminosilicate zeolite having a silica/alumina ratio of at least about 12 and a Constraint Index of about 1 to about 12; and recovering at least 95 wt.% of an upgraded oil which forms substantially no particulate wax at said predetermined storage temperature.

16. The method described in claim 15 wherein said catalyst consists essentially of ZSM-5 in a matrix and a hydrogenation component, and is further characterized by an alpha value in the range of about 25 to 150.

* * * * *